United States Patent [19]

Kneusels

[11] 4,218,109

[45] Aug. 19, 1980

[54] ELECTRICAL CONNECTOR ASSEMBLY

[75] Inventor: Max B. Kneusels, Secheim, Fed. Rep. of Germany

[73] Assignee: General Motors Corporation, Detroit, Mich.

[21] Appl. No.: 964,194

[22] Filed: Nov. 28, 1978

[30] Foreign Application Priority Data

Dec. 8, 1977 [DE] Fed. Rep. of Germany ..... 2754581

[51] Int. Cl.[2] ..... H01R 15/16

[52] U.S. Cl. ..... 339/147 R; 339/223 R

[58] Field of Search ..... 339/147 R, 147 C, 100, 339/229, 237, 103 R, 153, 173, 219 F, 263 L, 223 R, 276 R, 276 S, 276 T, 95 B, 232, 263 B; 337/231-235, 251, 252

[56] References Cited

U.S. PATENT DOCUMENTS

| | | | |
|---|---|---|---|
| 1,067,702 | 7/1913 | Wiegand | 339/223 R |
| 1,994,251 | 3/1935 | Mueller | 339/232 X |
| 2,111,745 | 3/1938 | Boothe | 337/251 X |
| 2,151,807 | 3/1939 | Graff-Baker | 339/103 R |
| 2,476,429 | 7/1949 | Paules | 339/100 |
| 2,668,885 | 2/1954 | Gerlat | 339/147 P X |
| 2,887,667 | 5/1959 | Wolfe et al. | 339/100 |
| 3,291,894 | 12/1966 | Sampson | 174/52 R |

FOREIGN PATENT DOCUMENTS

| | | |
|---|---|---|
| 1488404 | 4/1969 | Fed. Rep. of Germany . |
| 335642 | 10/1930 | United Kingdom . |
| 589656 | 6/1947 | United Kingdom . |
| 830163 | 3/1960 | United Kingdom . |
| 1011997 | 12/1965 | United Kingdom . |

*Primary Examiner*—Paul A. Bell
*Assistant Examiner*—Eugene F. Desmond
*Attorney, Agent, or Firm*—F. J. Fodale

[57] ABSTRACT

A fused electrical connector for connecting an insulated conductor to a terminal is formed of two parts of unequal length, each being formed at one end for attachment to the terminal and the longer part being formed at its other end for securing on the insulation of the conductor, the shorter part being formed to retain one end of the fuse element the opposite end of which is adapted to be inserted into, or secured to, the wires of the conductor.

6 Claims, 7 Drawing Figures

Fig.1
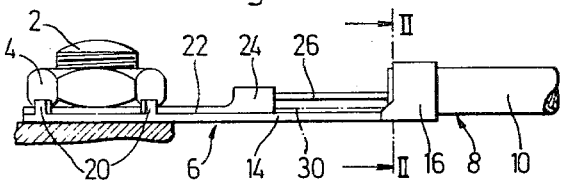
Fig.2
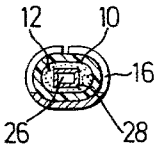
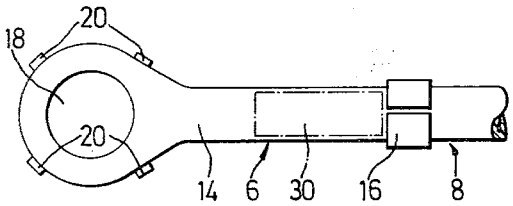
Fig.3
Fig.4
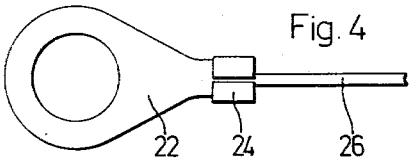
Fig.7
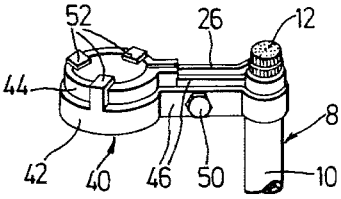
Fig.5
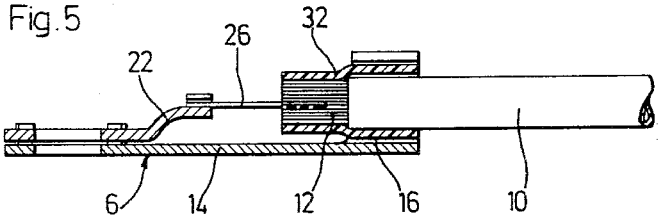
Fig.6
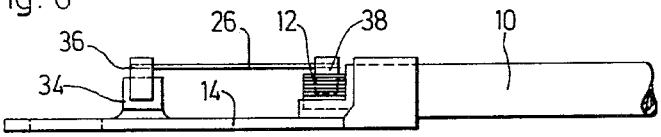

ELECTRICAL CONNECTOR ASSEMBLY

This invention relates to an electrical connecting element for joining a conductor provided with an insulating sheathing to an electric terminal, consisting of a cable grip or the like, with which a fuse element is in direct communication, particularly for circuits in motor vehicles.

In circuits for motor vehicles it is known to provide a fuse in the main cable from which leads branch off to the individual current-consuming devices. For this purpose, by means of clamping connectors, a fuse strip is inserted near to the attachment point of the conductor, i.e. at the junction with the cable grip, or the like. When the strip has fused, it is an awkward and time-wasting operation to insert a new fuse strip, especially as the end of the conductor is separated from the attachment point, i.e. the cable grip, and therefore under certain circumstances, it lies at an inaccessible place or becomes suspended there.

German specification DT-OS No. 1 488 404 likewise makes it known to provide a fuse between a battery terminal and a battery cable. This is arranged in an insulating housing provided between battery terminal and cable, and may be changed as an ordinary fuse, or may be designed to cut-in again automatically. Here again, replacement of the fuse proves to be very complicated and above all this type of fuse is quite expensive, since nearly all the parts involved constitute components which are either additional or are specially made for the purpose.

The present invention is based on the problem of creating a fuse of this kind which involves little expenditure, is also easily fitted and can be readily replaced. According to the invention, this is attained by ensuring that the cable grip or the like is connected to the insulating sheathing of the conductor, and the fuse element is arranged between the core of the conductor and the terminal.

Preferably, the fuse element is not connected to the terminal directly, the cable grip or the like consisting of two parts which lie on or against each other, one part having a greater length, in the direction towards the conductor, than the other part and being connected by its end to the insulating sheathing, whilst the shorter part is connected with the fuse element.

The construction is simplified if the fuse element, connected to the shorter part, for example by clamping, consists of a wire which can be pushed into the core from the front end thereof, the wire being formed with a pointed end and merely being pressed into the end of a core composed of wire strands. The need for easy changing of the fuse element may of course also make it necessary to provide a contact guide for the fuse wire. Another way of connecting the fuse element to the core would be to screw the fuse element into the core.

Since the usual insulating sheathing of the conductor is relatively soft, the clamping of the part of the cable grip on to the insulating sheathing (or its connection to the latter in any other manner) should be carried out over a greater length than usual. In any case, in order to ensure a secure and durable connection between the cable grip and the insulating sheathing, it is advisable to make a firm application of a sleeve of harder plastics material to the end of the insulating sheathing and to the free end of the core, and then to press or clamp the part of the cable grip on to this sleeve.

Embodiments of the invention are illustrated in the accompanying drawing in which:

FIG. 1 is a side elevation of the device according to the invention;

FIG. 2 is a section along line II—II of FIG. 1;

FIG. 3 is a plan of the device with the fuse element removed;

FIG. 4 is a plan of the fuse element with a portion of the cable grip;

FIG. 5 is a sectional elevation of a further embodiment;

FIG. 6 is a side elevation of another embodiment of the device, and

FIG. 7 is a perspective view of the device in conjunction with a terminal.

The drawings show an electric terminal 2 which consists of a threaded pin or bolt which may be, for example, in the circuit of a motor vehicle or on an electrical conductor. The conductor 8 is connected to terminal 2 in known manner by a threaded nut 4 and a cable grip 6. Conductor 8 consists of an insulating sheath 10 and an electrically conducting core 12. The cable grip 6 consists of a part 14 and a shorter part 22, one end 16 of the part 14 being clamped on to the insulating sheathing 10 of conductor 8 and the other end being provided with a circular aperture 18 to enable it to be mounted on the terminal 2. The part 14 also has lugs 20 which can be bent over so as to secure the shorter part 22 thereon.

The part 22 has adjacent the terminal 2, approximately the same outline shape as part 14, and at its other end 24, a wire fuse element 26 is secured, as by clamping, or in any other suitable manner, for example by soldering. In the embodiment illustrated the cross-section of the fuse element 26 is rectangular, as will be apparent from FIG. 2. From this figure it will also be seen that a sleeve 28 of rectangular cross-section is inserted into the core 12 to form a plug-in contact sleeve for the fuse element 26, which can therefore easily be replaced after it has fused. In order to release the part 14, it is merely necessary to remove the nut 4 and then to bend up the lugs 22.

In order to prevent a flash-over from the fuse element 26 to part 14, the latter may be provided at the appropriate place with an insulating layer 30, as indicated in broken lines. Since the part 14 actually performs no electrically conducting function, it may also consist of a non-conducting material, for example, plastics material, in which case it can then be mounted on the insulating sheathing 10, or connected to it.

However, if a clamping connection is necessary or desirable between the insulating sheathing and the part 14 and if this sheathing is unsuitable for this purpose, an appropriate solution of the problem can be found by the arrangement according to FIG. 5. Here, a sleeve 32 is mounted, for example, clamped, on to the insulating sheathing 10 and on to an exposed end of core 12, this sleeve consisting of a material which is harder than the insulating sheathing 10. Then the end 16 of part 14 is clamped on to sleeve 32 or connected to the latter in any other suitable manner. In the main, the remaining parts of the device in FIG. 5 correspond to those in FIG. 1 and bear the same reference numerals.

FIG. 6 shows a further embodiment. Here the part 14 of the cable grip is provided with a projection 34 similar to a knife contact. The fuse element 26 is connected to spring contacts 36 which are pushed on to the projection 34. Similarly, spring contacts 38 at the other end of the fuse element can be pushed on to or into the free end of core 12. Between the end of core 12 and the section of part 14 lying thereunder, the sheathing 10 has been left remaining, in order that the insulation may be preserved. This device has the advantage that when replacing the fuse element 26, the nut does not have to be removed from the terminal.

FIG. 7 shows the device applied to a clamp connector. Here, similar to the cable grip in FIG. 1, the terminal 40 consists of parts 42 and 44. By means of the clamping arms 46, and a clamping screw 50, part 42 is connected to the insulating sheathing 10 of conductor 8. The fuse element 26, which here embraces the core 12 of the conductor with a clamping action, is connected to part 44 which is secured to part 42 by lugs 52.

What is claimed is:

1. An electrical connector assembly for connecting to a terminal an electrical cable having a conductor core with an insulating sheathing therearound, said assembly including an electrically conductive cable grip and a fuse element, one end of said cable grip being formed for attachment to said terminal and the other end being formed for connection to the insulating sheathing of said conductor, and one end of said fuse element being connected to said cable grip and the other end of said fuse element being formed for engagement with the core of said conductor.

2. An electrical connector assembly for connecting to a terminal an electrical cable having a conductor core with an insulating sheathing therearound, said assembly including a cable grip having a fuse element directly connected thereto, said cable grip being formed of two juxtaposed parts of unequal length, each formed at one end for attachment to said terminal, the longer of said parts being formed at its other end for connection to the insulating sheathing of said conductor and the shorter of said parts being formed at its other end for the connection thereto of one end of said fuse element, the other end of said fuse element being formed for engagement with the core of said conductor.

3. An electrical connector assembly for connecting to a terminal an electrical cable having a conductor core with an insulating sheathing therearound, said assembly including a cable grip having a wire fuse element directly connected thereto, said cable grip being formed of two juxtaposed and releasably connected parts of unequal length, each formed at one end for attachment to said terminal, the longer of said parts being formed at its other end for connection to the insulating sheathing of said conductor and the shorter of said parts being formed at its other end for the connection thereto of one end of said fuse element, the other end of said fuse element being formed for insertion into the core of said conductor.

4. An electrical connector assembly for connecting to a terminal an electrical cable having a conductor core with an insulating sheathing therearound, said assembly including a cable grip having a wire fuse element directly connected thereto, said cable grip being formed of two juxtaposed parts of unequal length, each formed at one end for attachment to said terminal, the longer of said parts being formed at said one end with deformable lugs by which it can be detachably connected to said shorter part and being formed at its other end for connection to the insulating sheathing of said conductor and the shorter of said parts being formed at its other end for the connection thereto of one end of said fuse element, the other end of said fuse element being formed for axial insertion into the core of said conductor.

5. An electrical connector assembly for connecting to a terminal an electrical cable having a conductor core with an insulating sheathing therearound, said assembly including a cable grip having a fuse element directly connected thereto, said cable grip being formed of two juxtaposed parts of unequal length, each formed at one end for attachment to said terminal, the longer of said parts being formed at its other end for connection to the insulating sheathing of said conductor and the shorter of said parts being formed at its other end for the connection thereto of one end of said fuse element, the other end of said fuse element being formed for engagement with the core of said conductor, and a layer of insulating material being provided on said longer part on that portion thereof opposite said fuse element when said assembly is connected with said terminal and said cable.

6. An electrical connector assembly for connecting to a terminal an electrical cable having a conductor core with an insulating sheathing therearound, said assembly including a cable grip having a fuse element directly connected thereto, said cable grip being formed of two juxtaposed parts of unequal length, each formed at one end for attachment to said terminal, the longer of said parts being made of insulating material and being formed at its other end for connection to the insulating sheathing of said conductor and the shorter of said parts being formed at its other end for the connection thereto of one end of said fuse element, the other end of said fuse element being formed for engagement with the core of said conductor.

* * * * *